US005459909A

United States Patent [19]

Nussberger

[11] Patent Number: 5,459,909

[45] Date of Patent: Oct. 24, 1995

[54] SEPARABLE CLASP

[76] Inventor: Gregor Nussberger, 8306 Mills Drive #539, Miami, Fla. 33183

[21] Appl. No.: 107,346

[22] Filed: Aug. 16, 1993

[51] Int. Cl.[6] ..... A44B 11/25

[52] U.S. Cl. ..... 24/597; 24/594; 24/596

[58] Field of Search ..... 24/591, 593, 594, 24/596, 597, 590, 116 A, 287, 109

[56] References Cited

U.S. PATENT DOCUMENTS

| | | | |
|---|---|---|---|
| 838,995 | 12/1906 | Hopkins | 24/594 |
| 2,879,572 | 3/1959 | Thogood | 24/594 |
| 4,709,454 | 12/1987 | Barnes | 24/597 X |
| 4,944,073 | 7/1990 | Haug | 24/590 |

*Primary Examiner*—James R. Brittain

[57] ABSTRACT

A connecting device is disclosed consisting of two parts, the first part being a male member (16) which includes a forward portion (17) and a rearward portion (32) attachable to an outside surface, device, structure or element (34). A female member (15) is provided, one side ready to connect to a surface, device or element (25), the receiving side (21) open. The shell (20) of the female member (15) having therein a forward receptacle portions (22) and a rearward receptacle portions (23) to pivot the forward portion (17) during insertion and to lock upon release. A method to engage the connecting device: inserting the male member (16) all the way into the female member (15) and releasing the male member (16). This action pivots the forward portion and locks the connecting device. A method to disengage the connecting device: first pressing the male member (16) all the way into the female member (15) and second releasing the male member (16). This pivots the forward portion (17) again. Third; repeating first and second step will cause the forward portion (17) to pivot again an disengage the connecting device.

10 Claims, 2 Drawing Sheets

SEPARABLE CLASP

BACKGROUND OF THE INVENTION (1) Field of Invention

The present invention relates to a connecting device; and more particularly to a clasp lock combination with a female member and an insertable male member for connecting two ends, such as those of a necklace, pearl strand, chain, cable, outside structure, surface, device or element.

(2) Description of Prior Art

Presently there are a number of clasps and locks. Most of these devices are designed for a very specific use and present no flexibility in utility.

(a) Most are plagued by the fact that the male member has to be inserted into the female member in an exact position, or the connecting device will not work.

(b) If, for example a chain or cable is twisted, present connecting devices will not straighten out such a connection.

(c) Furthermore, most clasps and locks necessitate to depress a plunger or device to operate. This for example, results in a difficult operation such as closing or opening a necklace behind the neck.

(d) Still, many people complain about braking their finger nails and chipping nail polish from these kind of structures.

(e) Often plungers catch on to objects and tear garments.

(f) It is very difficult to open and close most clasps and locks with one hand only.

(g) Most connecting devices take great effort for a blind person to operate.

(h) Connecting devices that offer a simple operation result in weak security, either because of lack of structure or lack of strength. For example, the jewelry clutch, a connecting device, U.S. Pat. No. 4,543,695 (1985) offers ease of use. However this connecting device does not provide security. The lack of a locking mechanism makes it possible to pull the device apart. Security and strength is a very crucial consideration if the connecting device connects, for example a valuable device, strand of pearls, chain or cable.

Consequently, there is a need to overcome the above problems, to obtain a secure connecting device,without compromising ease of use. A device which is structured to be versatile in its operation to the extent of being capable of many applications in various fields.

OBJECTS AND ADVANTAGES

Accordingly, it is an object of this invention to provide a universal clasp lock combination, which is designed to increase security, ease of use and is flexible in many utilities. Field of utility extends from space technology, where structures and devices have to be readily and securely attached, to electronic industries where electric cables need to be connected, to jewelry industry. For easy reading, the clasp lock combination is herein and from now on referred to as a clasp. Several objects and advantages of the present invention are:

(a) to provide a clasp that does not need any exact position to connect;

(b) to provide a clasp that is capable of straightening out a twisted connection, where the male member is capable of pivoting inside the female member, even when the clasp is engaged;

(c) to provide a clasp that does not need any plunger to be depressed, either to connect or to disconnect;

(d) to provide a clasp that does not break finger nails and chip nail polish;

(e) to provide a clasp that does not catch on to objects and tear garments;

(f) to provide a clasp that can be operated with one hand;

(g) to provide a clasp that can be operated by a blind person; and (h) to provide a clasp that offers simple operation and a high level of security.

In operation, the clasp of the present invention is structured to permit ready attachment by inserting a male member into a female member and release. In order to release, the male member must be depressed into the female member at least one time. The whole operation of connecting and releasing can be done blindly. Further objects and advantages of my invention will become apparent from a consideration of the drawings and ensuing Description.

BRIEF DESCRIPTION OF THE DRAWINGS

In the drawings, closely related figures have the same number but different alphabetic suffixes.

FIG. 1 is a side view, shown in partial cutaway; a male member half way inserted into a female member.

FIG. 2 is a side view, shown in partial cutaway; the forward portion touching the rearward receptacle portion.

FIG. 3 is a side view, shown in partial cutaway; the male member released and in locked position.

FIG. 8 shows a perspective view of a first alternate male member.

FIG. 10 shows a perspective view of a second alternate male member.

FIG. 11 shows a perspective view of a third alternate male member.

FIG. 12 shows a perspective view of the preferred embodiment.

REFERENCE NUMERALS IN DRAWINGS

| | | | |
|---|---|---|---|
| 15 | Female member | 29 | Pivoting forward guide |
| 16 | Male member | 29a | Pivoting stem (FIG. 7, 8) |
| 17 | Forward portion | 29b | Pivoting stem (FIG. 9, 10) |
| 20 | Shell | 30 | Spring |
| 21 | Receiving end | 31 | Slide portion |
| 22 | Forward receptacle portion | 32 | Rearward portion |
| 22a | Forward receptacle portion | 33 | Attachable structure |
| 23 | Rearward receptacle portion | 34 | Outside surface, device or element |
| 23a | Rearward receptacle portion | 35 | Raised edge |
| 24 | Attachable structure | 36 | Arms |
| 25 | Surface, device or element | 36a | Arms |
| 26 | Rearward saw-toothed surface | 37 | Shell (male member) |
| 26a | Rearward saw-toothed front view (60 degree divisions) | 38 | Bolt |
| | | 40 | Opening |
| 26b | Rearward saw-toothed surface | 41 | Fastening device (screw or bolt) |
| 26c | Rearward saw-toothed front view (90 degree divisions) | 42 | Fastening device |
| | | 43 | Opening |
| 27. | Forward saw-toothed surface | 44 | Rod |
| 27a | Forward saw-toothed front view (60 degree divisions) | 45 | back portion |
| | | 46 | Flexible grippers |
| 27b | Forward saw-toothed surface | 47 | Tubular wall |
| 27c | Forward saw-toothed front view (90 degree divisions) | 48 | Rearward portion |
| | | 49 | Cavity (FIG. 7) |
| 28 | Stem | 50 | Cavity (FIG. 12) |
| 28a | Stem (FIG. 11) | 51 | Through hole |

DETAILED DESCRIPTION OF THE PREFERRED EMBODIMENT

Figure 1:
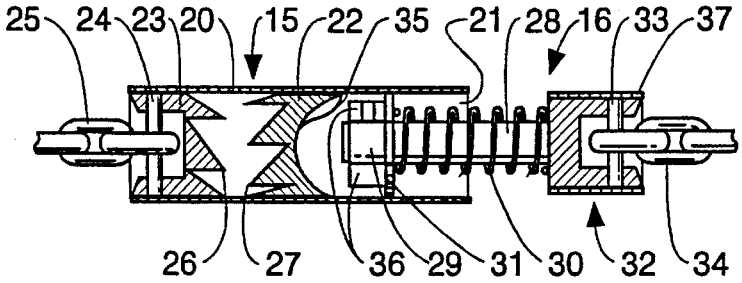
FIGS. 1–3 shows the invention at various stages of operation.

Referring to FIG. 1, the clasp of this invention includes a female member 15 and a male member 16. The female member 15 contains a tubular shell 20 which is open at a receiving end 21. Shell 20 having therein a forward receptacle portion 22 and a rearward receptacle portions 23. Rearward receptacle portion 23 shown in cross-sectional view, contains an attachable structure 24 for attaching the female member 15 to an outside surface, device or element 25. Forward receptacle portion 22 contains a raised edge 35. A forward saw-toothed surface 27 and a rearward saw-toothed surface 26 will be explained in more detail in FIG. 2,3, 4 and 5.

Cooperating with female member 15, is male member 16 which has a stem 28, a pivoting forward guide 29 comprising two arms 36, a slide portion 31, a spring 30 for tensioning slide portion 31 along stem 28 against arms 36. A rearward portion 32 with a shell 37, contains an attachable structure 33 for attaching male member 16 of this invention to an outside surface, device or element 34.

Shown in FIG. 1 is the first stage of operation, where male member 16 is inserted half way into female member 15. Arms 36 are about to hit raised edge 35 of forward receptacle portion 22. The purpose of raised edge 35 is to pivot forward guide 29 and arms 36 into position so that forward guide 29, arms 36 and stem 28 can pass through an opening 40 (see FIG. 4, 5 and 6) within forward receptacle portion 22.

Figure 2:
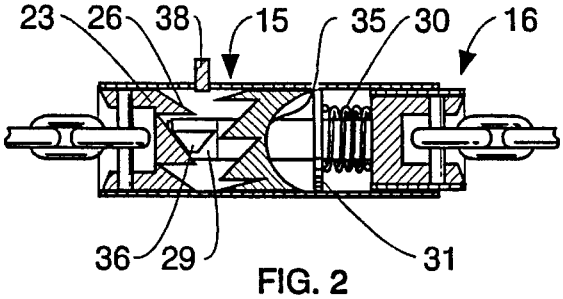

Referring now to FIG. 2, it will be seen that male member 16 has been inserted into female member 15. Arms 36 (only one side visible) touch rearward saw-toothed surface 26 of rearward receptacle portion 23 and cause the forward guide 29 and arms 36 to pivot by 30 degrees as male member 16 is inserted all the way against rearward receptacle portion 23. Slide portion 31 is pressed against raised edge 35 by spring 30. An alternate bolt 38 is shown in its open position, not interfering with any of the forward guide 29 and the arms 36 pivoting action.

Figure 3:
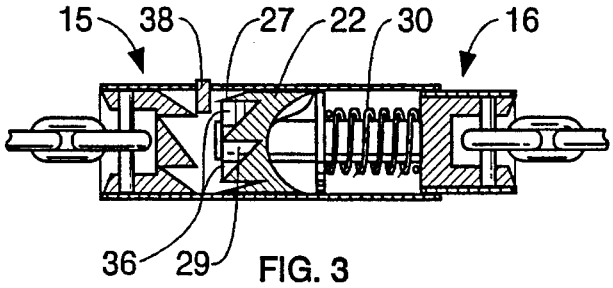

Referring now to FIG. 3. Releasing male member 16 and allowing it to be pulled backward by spring 30 to buttress against forward saw-toothed surface 27 of forward receptacle portion 22. This action causes arms 36 to catch on to forward saw-toothed surface 27 and pivot forward guide 29 and arms 36 by an additional 30 degrees to lock male member 16. Alternate bolt 38 is shown in dead-lock position, making it impossible to depress male member 16 into female member 1.

A method to disengage the clasp includes: first, pressing male member 16 against female member 15. This action will pivot arms 36 and forward guide 29 by an additional 30 degrees. Second, releasing male member 16, allowing it to fall back against forward receptacle portion 22, where arms 36 and forward guide 29 are pivoted by an additional 30 degrees. Third, repeating said first and second step which adds an additional 60 degrees, and when added to the 60 degrees from the engagement process results in a 180 degree turn, allowing arms 36 of forward guide 29 pull through forward receptacle portion 22 by force of spring 30, which releases the clasp.

Figure 4:
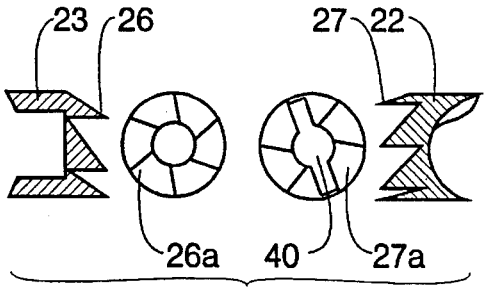
FIG. 4 shows a forward and rearward receptacle portion in two push configuration, a cross-section and saw-toothed side view of each respective part.

Referring now to FIG.4. This Shows forward receptacle portion 22 in cross-sectional view with its forward saw-toothed surface 27. A forward saw-toothed front view 27*a*, with opening 40. Rearward receptacle portion 23 in cross-sectional view with its rearward saw-toothed surface 26 and a rearward saw-toothed front view 26*a*.

The main purpose of FIG.4 is for further understanding of the angles involved. Rearward receptacle portion 23 and forward receptacle portion 22 are divided in 60 degree increments as seen in front view 26*a* and front view 27*a*. However, arms 36 (FIG. 2) land in the approximate middle of each saw-tooth, resulting in a 30 degree turn. 60 degrees for engaging and 120 degrees for disengaging the clasp. In brief: pushing the male and female member together then releasing it, locks the clasp. To disengage, depress the male member twice.

Figure 5:
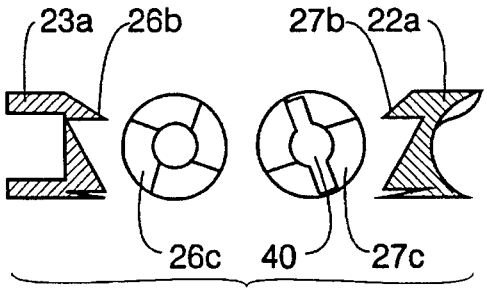
FIG. 5 shows the forward and rearward receptacle part in one push configuration, a cross-sectional and saw-toothed side view of each respective part.

Referring now to FIG. 5. As an alternate embodiment this Shows a forward receptacle portion 22*a* in cross-sectional view with a forward saw-toothed surface 27*b*. A forward saw-toothed front view 27*c*, with opening 40. Rearward receptacle portion 23*a* in cross-sectional view with its rearward saw-toothed surface 26*b* and a rearward saw-toothed front view 26*c*. Following closely by the embodiment of FIG. 4 which is similar to the embodiment of FIG. 5 resulting in a clasp that disengages at the first depression of male member 16.

The main purpose of FIG.5 is for further understanding of the angles involved. Rearward receptacle portion 23*a* and forward receptacle portion 22*a* are divided in 90 degree increments as seen in front view 26*c* and front view 27*c*. However, arms 36 (as seen in FIG. 2) land in the approximate middle of each saw-tooth, resulting in a 45 degree turn. 90 degree for engaging and 90 degree for disengaging the clasp. In brief: pushing the male and female member together and releasing it, locks the clasp. To disengage, depress the male member once.

Figure 6:
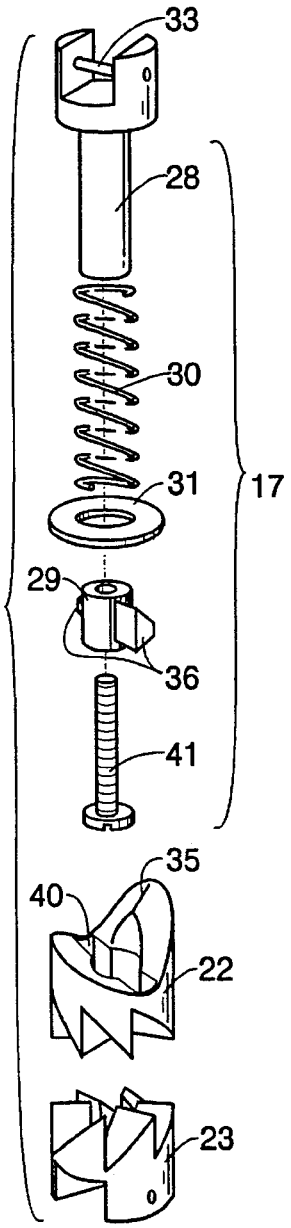
FIG. 6 shows an exploded view of all the parts involved, except the shells. Embodiment shown relates to FIG. 12

Referring to FIG. 6, shows an exploded view of all the inner parts involved. A forward portion 17 of this invention, which comprises all of the male parts necessary to make the clasp engage. Shown is raised edge 35 that guides arms 36 of forward guide 29 and stein 28 through opening 40 of forward receptacle portion 22, against rearward receptacle portion 23. A fastening device 41 is screwed or bolted into stem 28 that holds forward guide 29 tight enough to let it pivot. Slide portion 31 is pushed forward by spring 30 against arms 36. The attachable structure 33 aids in attaching an outside surface, device or element.

FIG. 7, 8, 9, 10 and 11, show alternate embodiments to stem 28 and forward guide 29. They do not change the main principle of the invention, slide portion 31 and spring 30 all stay the same as the preferred embodiment.

Figure 7:
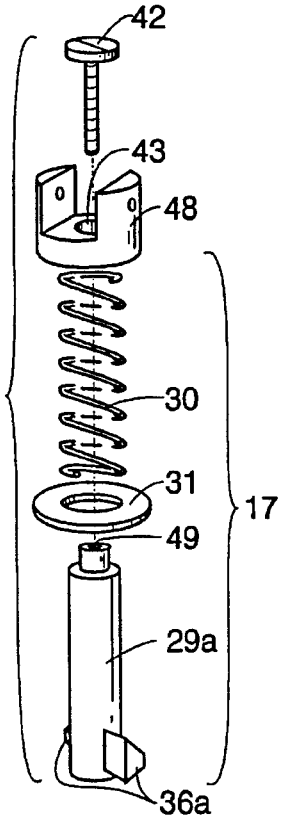
FIG. 7 shows a first alternate male member of the preferred embodiment in perspective, exploded view. Relating to FIG. 8.
Figure 8:
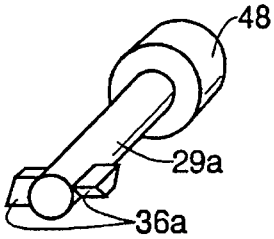
FIG. 8, 10, 11 and 12 show the forward and rearward portion of the male member, without slide and spring portion.

Referring to FIG.7 and 8, there is shown a first alternate embodiment with a pivoting stem 29*a* of the forward portion 17. Pivoting stem 29*a* is held by a fastening device 42 through an opening 43 of a rearward portion 48 into a cavity 49. Spring 30, the arms 36*a* and slide portion 31 have the identical purpose as the preferred embodiment in FIG. 12.

Figure 9:
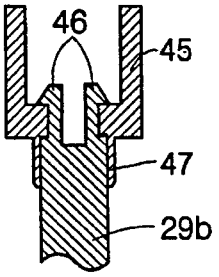
FIG. 9 shows a cross-sectional view relating to FIG. 10
Figure 10:
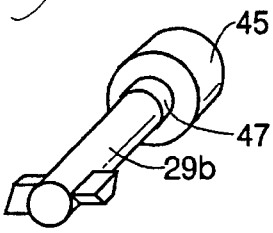

Referring to FIG. 9 and 10, where FIG. 9 is in cross sectional view, there is shown a second alternate embodiment with a pivoting stem 29*b*. Similar to FIG. 7 and 8. The pivoting stem 29*b* is snapped into the back portion 45 by two flexible gripers 46. A tubular wall 47 guides pivoting stem 29*b*. For this mechanism to work properly the parts have to be manufactured in a flexible material. The purpose of this embodiment is mainly for the manufacturing stage, making it more efficient to assemble the male member 16.

Figure 11:
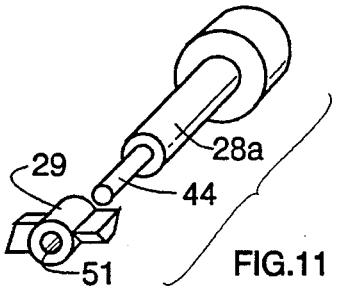

Referring to FIG. 11, there is shown a third alternate embodiment. The main difference being that a stem 28*a* is extended with a rod 44 that is smaller in diameter than a through hole 51 in the forward guide 29. When assembled, rod 44 will stick out of through hole 51, making it possible to rivet the end of rod 44. The purpose of this embodiment is mainly for the manufacturing stage.

Figure 12:
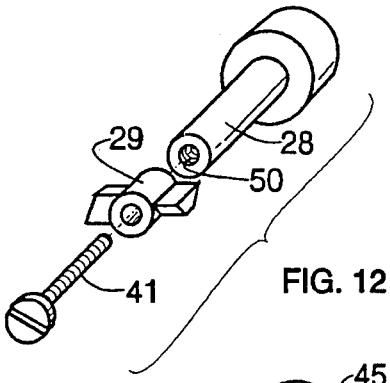

Referring to FIG. 12, there is shown in exploded view, the components of the preferred embodiment. The fastening device 41 screwed or bolted into a cavity 50 of stem 28 that holds forward guide 29 tight enough to let it pivot.

It is therefore to be understood that the following claims are intended to cover all of the generic and specific features of the present invention herein described, and all statements of the scope of the invention which as a matter of language, might be said to fall there between.

I claim:

1. A connecting device for connecting two structures comprising:

(a) a male member comprising a forward portion and a rearward portion attachable to an outside, structure, said male forward portion comprising an elongated stem, said elongated stem comprising a forward section, said forward section comprising at least one arm, said male member including a resilient means for biasing said male member for release from a capturing female member, (b) a female member comprising a housing, said housing comprising a forward receptacle portion, said forward receptacle portion consisting of forward component permitting insertion of said male forward section and a rearward component, said forward component and said rearward component are spaced from each other so as to provide a means for pivoting said male forward section and extraction of said male forward section with at least one push-pull operation both said forward component and said rearward component are fixedly secured to said housing.

2. A connecting device as in claim 1, said forward component comprising a pivoting means to pivot said male forward section upon insertion into said female member, whereby said pivoting means will eliminate the need to find a particular axial insertion position.

3. A connecting device as in claim 1, said rearward component is attachable to an outside

4. A connecting device as in claim 1, said male forward portion comprising a slide portion along said elongated stem, said resilient means for tensioning said slide portion forwardly along said elongated stem, whereby said sliding portion guides said male member upon insertion into said female member.

5. A connecting device as in claim 1, said male forward section has a separate part comprising an axial through bore, said elongated stem comprising a forward stem, said forward section fitting over said forward stem, allowing said forward section to pivot, said stem being crimped to form a head large enough not to release said forward section.

6. A connecting device as in claim 1, said male forward portion comprising a cavity facing the male rearward portion, said male rearward portion comprising an opening, said male forward portion being attached to said male rearward portion by connecting means comprising a screw or bolt, said connecting means is inserted through said male rearward opening into said male forward portion.

7. A connecting device as in claim 1, said elongated stem is snapped into said male rearward portion by means of flexible grippers.

8. A connecting device as in claim 1, said female forward component comprising a saw-toothed side, divided by approximately 60 degrees and said female forward component comprising saw-toothed side divided by approximately 60 degrees, whereby this configuration necessitates the male and female member to be depressed once for engaging the device, and twice to disengage.

9. A connecting device as in claim 1, said female forward component comprising a saw-toothed side, divided by approximately 90 degrees and said female rearward component comprising a saw-toothed side divided by approximately 90 degrees, whereby this configuration necessitates the male and female member to be depressed once for engaging the device, and once to disengage.

10. A connecting device as in claim 1, said female member including a bolt means to prevent the connecting device from being engaged or disengaged, said bolt means is positioned in front of said male forward section when in closed position, whereby the male part is effectively blocked and unable to disengage.

* * * * *